United States Patent [19]

Kikuchi

[11] 4,222,584

[45] Sep. 16, 1980

[54] SKI BOOT HEEL BINDING

[75] Inventor: Toshikazu Kikuchi, Nagareyama, Japan

[73] Assignee: Hope Co., Ltd., Tokyo, Japan

[21] Appl. No.: 7,831

[22] Filed: Jan. 30, 1979

[30] Foreign Application Priority Data

Feb. 8, 1978 [JP] Japan ..... 53-13142

[51] Int. Cl.[2] ..... B63C 9/08

[52] U.S. Cl. ..... 280/626

[58] Field of Search ..... 280/626, 616, 617, 628

[56] References Cited

U.S. PATENT DOCUMENTS 3,933,363 1/1976 Schweizer et al. ..... 280/626

*Primary Examiner*—Stanley H. Tollberg

*Attorney, Agent, or Firm*—Wenderoth, Lind & Ponack

[57] ABSTRACT

A ski boot heel binding having a pivotable heel engaging jaw member is provided with first and second cam members both swingably mounted to a supporting frame body on a base plate. The second cam member has a transverse rod slidably engaged with a recess formed in the rear part of the jaw member and acts upon the first cam member to swing back the latter against a spring force when the second cam member is rotated by the upward movement of the transverse rod engaging with the recess in the jaw member.

4 Claims, 5 Drawing Figures

SKI BOOT HEEL BINDING

BACKGROUND OF THE INVENTION

This invention relates to a ski boot heel binding having a heel engaging jaw pivotably connected to a supporting frame body on a base plate.

In a ski boot heel binding of the type set forth above, it is desired from the viewpoint of safety that the heel engaging jaw has a longer restorable stroke, which allows the jaw displaced to a position not reaching a heel releasing position to return to the normal heel engaging position. Also, it is desired that the binding can hold a ski boot with a relatively strong force at the initial stage of displacement of the jaw in order that a vertical play of the jaw by a relatively small upward shock can be eliminated.

The known ski boot heel bindings have various kind of locking means. These locking means can widely be divided into link locking system and cam locking system. The link locking system has an advantage that can gain a long restorable stroke of the heel engaging jaw. However, it was a disadvantage in the link locking system that the binding force applied to the jaw is proportionally decreased by increase of the amount of displacement of the jaw. Accordingly, it was experienced that even when a relatively small upward shock is applied to a ski boot, the jaw is vertically and largely vibrated without being displaced to a heel releasing position. Such vibration or vertical play of the ski boot is dangerous as it prevents accurate control of the ski.

On the other hand, it becomes possible in the cam locking system to afford a higher binding force to the jaw at the initial stage of displacement of the jaw by forming the cam member into a desired shape. Thus, the dangerous vertical play of the jaw can be minimized in the cam locking system. However, in the known cam locking system, a cam member is swingably supported to a frame and is pressed against a transverse rod, so that it was difficult to gain a long restorable stroke of the heel engaging jaw.

Accordingly, an object of the present invention is to provide a ski boot heel binding having the both advantages of the link locking system and cam locking system.

Another object of the present invention is to provide a ski boot heel binding having a longer restorable stroke with a desired high binding force minimizing a dangerous vertical vibration of a jaw at the initial stage of displacement thereof.

SUMMARY OF THE INVENTION

According to a ski boot heel binding of the present invention, first and second cam members are swingably mounted to a supporting frame body on a base plate. The second cam member in front of the first cam member has a transverse rod slidably engaged with a recess formed in the rear part of a heel engaging jaw member. The second cam member acts upon the first cam member to swing back the latter against a spring force when the second cam member is rotated by the upward movement of the transverse rod engaging with the recess in the jaw member. It is arranged such that the engagement of the transverse rod with the recess is released when the jaw member is displaced upwardly beyond a predetermined angle.

In such a structure of the present boot heel binding, when an abnormally high upward thrust is applied to the jaw member through a ski boot heel, the second cam member starts rotating due to the engagement of the transverse rod with the recess in the jaw member. By the rotation of the second cam member, the first cam member associated therewith is also rotated against the spring force. In such a manner, when the jaw member is pivotally moved up to a predetermined angle, the rod on the second cam member is suddenly disengaged from the recess, whereby the jaw member is displaced to a heel releasing position.

Thus, it becomes possible by forming the second cam member to a desired shape to apply a relatively high binding force to the jaw member at the initial stage of displacement thereof in order that the jaw member cannot be vibrated so easily by a relatively small upward shock on the ski boot. Also, it becomes possible by elongating the length of the recess, upon which the transverse rod slides, to gain longer restorable stroke of the jaw member.

Other objects and features of the present invention will become apparent from the detailed description of preferred embodiments thereof when taken in conjunction with the accompanying drawings, in which:

DESCRIPTION OF PREFERRED EMBODIMENTS OF THE INVENTION

Figure 1:
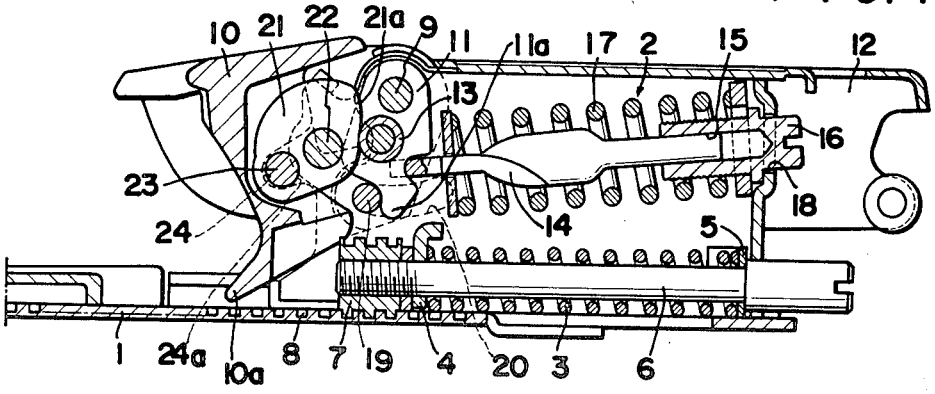
FIG. 1 is a partially sectioned side view showing a ski boot heel binding according to a first embodiment of the present invention.
Figure 2:
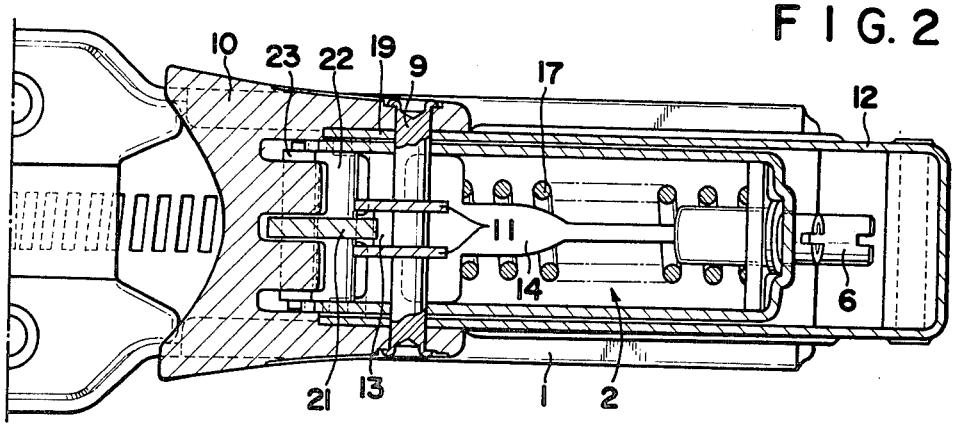
FIG. 2 is a partially sectioned top plane view showing the binding in FIG. 1.
Figure 3:
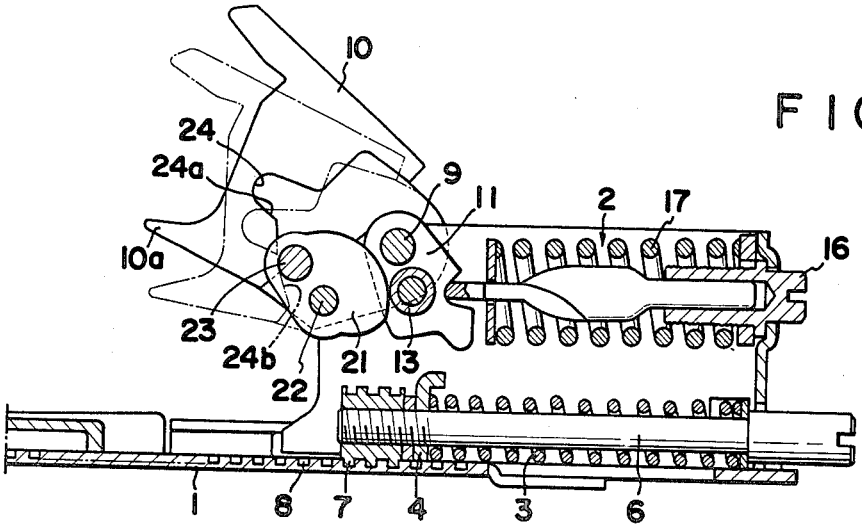
FIG. 3 is a partially sectioned side view showing the movement of a heel engaging jaw of the binding in FIGS. 1 and 2 displaced toward a heel releasing position.

Referring to a first embodiment of the present invention shown in FIGS. 1 through 3, a ski boot heel binding comprises a base plate 1 adapted to be attached on a ski plate. Mounted upon the base plate 1 is a supporting frame body 2 which is slidably engaged with the base plate 1 in a known manner. The frame body 2 is urged forwardly by a compression spring 3, the front end of which is received by a lateral plate 4 fixed to the frame body 2 and the rear end of which is received by a plate 5 mounted on an adjusting rod 6. The rod 6 has a worm 7 at the front end thereof which is engaged with a rack 8 formed on the base plate. Accordingly, by rotating the rod in either direction, the frame body 2 is moved back or forth along the base plate, so that the binding can fit correctly to a ski boot of a selected size.

Pivotably connected to the front end portion of the frame body 2 by a transverse shaft 9 is a heel engaging jaw 10 which is swingable upwardly from a normal heel engaging position shown in FIG. 1. Also, pivotably connected by the transverse shaft 9 are the upper part of first cam members 11-11 and the upper front part of an unlocking lever 12. The first cam members 11-11 are made of a pair of plates spaced from each other in the transverse direction and supports therebetween a roller 13 at the intermediate portion thereof. These first cam members 11-11 each has a concavity at the rear lower portion thereof in which the front end of a spring-receiving member 14 is fitted under pressure.

The spring-receiving member 14 is made of a plate, the intermediate portion of which is twisted at right angles relative to the front end portion thereof. The rear end portion of the spring-receiving member 14 is made to be slidably but snugly engaged with a bore 15 in an adjusting screw 16. A compression spring 17 is disposed around the spring-receiving member 14 to urge the latter forwardly. The adjusting screw 16 has a rear end knob loosely engaged through a hole 18 in the rear end wall of the frame body 2. In such an arrangement of the spring-receiving member 14, when the first cam members 11-11 are swung backwardly against the force of the spring 17, the rear end portion of the member 14 is deeply inserted into the bore 15 in the screw 16 and further compresses the spring 17. Although the inclination of the spring-receiving member 14 is somewhat changed when the first cam members 11-11 are swung backwardly, such a change of inclination is allowed by the loose engagement of the adjusting screw 16 with the hole 18 in the rear end wall of the frame body 2. The force of the spring 17 for urging the first cam members 11-11 forwardly can be adjusted by rotating the adjusting screw 16.

The first cam members 11-11 have lower end projections 11*a*-11*a* to the front part of which a pin 19 contacts. The pin 19 is secured to the front lower end of the unlocking lever 12 and penetrates arc-shaped slots 20 formed through both side walls of the frame body 2 about the transverse shaft 9. Accordingly, by lifting the rear end of the unlocking lever, which is pivotably connected to the supporting frame body 2 by the transverse shaft 9, the pin 19 is moved back along the arc-shaped slot 20 and the first cam members 11-11 are swung back about the transverse shaft 9.

The supporting frame body 2 has a front end portion projecting forwardly beyond the first cam members 11-11, to which a second cam member 21 is rotatably supported by a second transverse shaft 22. The second cam member 21 has an upper rear end surface section 21*a* which abuts against the roller 13 on the first cam members 11-11 in the boot heel engaging position. The second cam member also has a transverse rod 23 secured at the front end portion thereof. In the boot engaging position, the transverse rod 23 is slidably engaged with a recess 24 formed in the rear part of the heel engaging jaw 10. The recess 24 has a shape slightly inclined downwardly toward front from the rear open mouth portion thereof.

In such an arrangement of the ski boot heel binding according to the first embodiment shown in FIGS. 1 to 3, when an abnormal high upward shock is applied to a ski boot in the heel engaging position, the heel engaging jaw 10 starts rotating upwardly about the transverse shaft 9. At this time, due to the engagement of the transverse rod 23 with the recess 24, the second cam member 21 starts rotating about the second transverse shaft 22. Since the upper rear end surface section 21*a* of the second cam member 21 abuts against the roller 13 on the first cam members 11-11, the first cam members 11-11 are swung back about the transverse shaft 9 against the spring by the rotation of the second cam member 21. During the rotation of the heel engaging jaw 10, since the radius of curvature of the transverse rod 23 about the second transverse shaft 22 is much smaller than that of the recess 24 in the jaw 10 about the first transverse shaft 9, the transverse rod 23 slides back along the lower surface 24*a* of the recess 24 and is disengaged from the recess 24 at a predetermined angle of the heel engaging jaw, thereby displacing the jaw to a heel releasing position shown in FIG. 3.

In the first embodiment of the present invention, since the space between the second transverse shaft 22 and the upper rear end surface section 21*a* of the second cam member 21 sharply increases toward the top of the cam member 21 in the boot heel engaging position shown in FIG. 1, the heel engaging jaw 10 cannot be displaced upwardly unless a relatively high upward shock is applied initially to a ski boot. This means that the present binding can hold the ski boot with a relatively strong force at the initial stage of displacement of the jaw. Thus, by changing the space between the second transverse shaft 22 and the upper rear end surface section 21*a* of the second cam member 21, it becomes possible to afford a relatively strong desired binding force to the jaw at the initial stage of displacement thereof.

Further, since the displaced boot heel engaging jaw can return to the normal position while the transverse rod 23 remains in the recess 24, it becomes possible to extend the restorable stroke of the jaw by elongating the lower surface 24*a* of the recess 24.

The present boot heel binding displaced to the heel releasing position as shown in FIG. 3 can be reset to the normal heel engaging position merely by stamping down a pedal 10*a* in the jaw 10. Namely, when the pedal 10*a* is stamped down by the boot heel, due to the lowering of the jaw 10 by rotation about the transverse shaft 9, the transverse rod 23 on the second cam member 21 slides on the lower curved end surface 24*b* of the jaw 10 toward the recess 24 and then enters into the recess 24. Thereafter, by the successive downward movement of the jaw, the second cam member 21 rotates in the counterclockwise direction and, simultaneously, the first cam members 11-11 swing in the clockwise direction from the position shown in FIG. 3, whereby the binding take the boot heel engaging position shown in FIG. 1.

On the other hand, in order to displace the heel engaging jaw to the heel releasing position at will, it is only required to lift the rear end of the unlocking lever 12. That is, when the rear end of the unlocking lever 12 is lifted, the pin 19 at the front lower end of the lever 12 acts on the first cam members 11-11 to swing back the latters about the transverse shaft 9. At this time, due to a supplemental spring (not shown) disposed between the jaw 10 and the frame body 2, the jaw 10 is swung up and take the boot heel releasing position.

Figure 4:
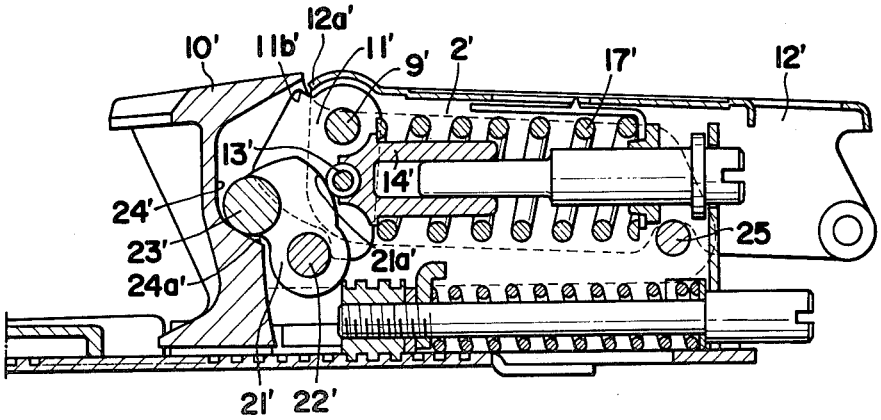
FIG. 4 is a vertically sectioned side view showing a ski boot heel binding according to a second embodiment of the present invention.
Figure 5:
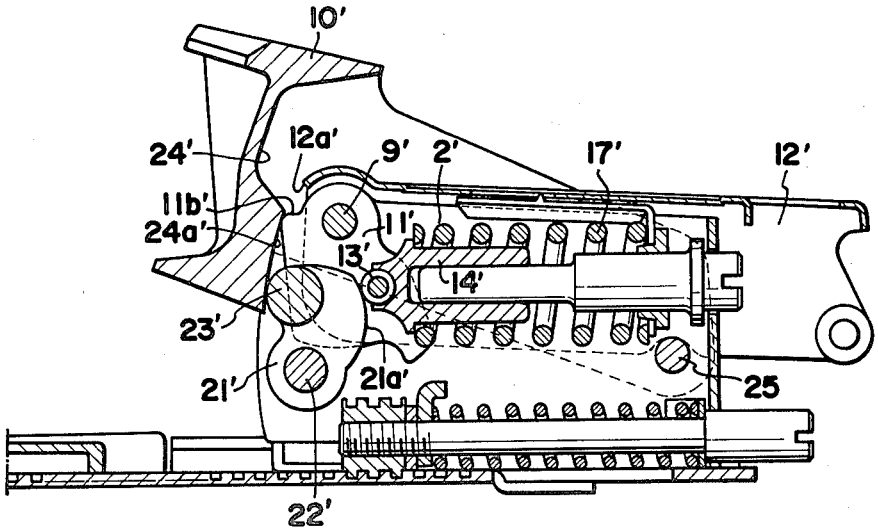
FIG. 5 is a partially sectioned side view showing the movement of a heel engaging jaw of the binding in FIG. 4 displaced to a heel releasing position.

Referring now to a second embodiment of the present invention shown in FIGS. 4 and 5, a heel engaging jaw 10' has side plates extending rearwardly along the side walls of the frame body 2' and connected thereto at the rear lower portion thereof by a pivot 25. First cam members 11'-11' as well as an unlocking lever 12' is pivoted to a supporting frame body 2' by a first transverse shaft 9'. The unlocking lever 12' has a front upper end 12'*a* adjacent to a shoulder portion 11'*b* of the first cam members and is arranged in such a manner that when the rear end of the unlocking lever 12 is lifted, the front upper end 12*a'* thereof acts upon the shoulder portion 11'*b* of the first cam members to forcedly swing back the latters against the spring 17' about the first transverse shaft 9', whereby the jaw 10' is displaced to a heel releasing position by the help of a supplemental spring (not shown) urging the jaw upwardly.

A second cam member 21' is pivoted at the lower portion thereof to the supporting frame 2' by a second transverse shaft 22' and has a transverse rod 23' at the front end above the shaft 22'. The transverse rod 23' is slidably disposed in a recess 24' in the boot heel engaging position.

By the upward movement of the jaw 10' about the pivot 25, the second cam member 21' rotates about the transverse shaft 22' due to the engagement of the transverse rod 23' with the recess 24'. The rotation of the second cam member 21' is carried out by compressing the spring 17 since the upper rear end surface section 21'*a* of the second cam member 21' pushes back a roller 13' on a spring-receiving member 14'. When the jaw 10' is moved up to a predetermined angle about the pivot 25, the transverse rod 23' is disengaged from the recess 24' in the jaw, whereby the jaw takes an unlocking position shown in FIG. 5.

Other structures and operations of the binding according to the second embodiment is substantially the same as those of the first embodiment.

Thus, as in the case of the first embodiment, by forming the upper rear end surface section 21'*a* of the second cam member into a desired shape or contour, it becomes possible to afford a relatively strong desired binding force to the jaw at the initial stage of displacement thereof. Also, it becomes possible to extend the restorable stroke of the jaw by elongating the lower surface 24'*a* of the recess 24'.

Although the present invention has been described with reference to preferred embodiments thereof, many modifications and alterations may be made within the spirit of the present invention.

What is claimed is:

1. A ski boot heel binding comprising a base plate adapted to be attached on a ski plate, a supporting frame body mounted on said base plate, a heel engaging jaw member pivotably connected to said frame body, a first cam member swingably connected to said frame body, a spring for urging said cam member forwardly, and means associated with said cam member for normally depressing said jaw member downwardly, wherein said means comprises a second cam member rotatably connected to said frame body in front of said first cam member, said second cam member having a transverse rod slidably engaged with a recess formed in the rear part of said jaw member, said second cam member acting upon said first cam member to swing back the latter against said spring when said second cam member is rotated by the upward movement of said transverse rod engaging with said recess in said jaw member.

2. A ski boot heel binding as claimed in claim 1, wherein said first cam member has a roller supported thereon to which a rear end surface of said second cam member abuts.

3. A ski boot heel binding as claimed in claim 1 or 2, wherein said transverse rod on said second cam member is arranged to slide along the lower surface of said recess when said jaw member starts rotating upwardly from a normal heel engaging position and to be disengaged therefrom when said jaw member is rotated to a predetermined angle.

4. A ski boot heel binding as claimed in claim 2, wherein the space between a shaft rotatably connecting said second cam member and an upper rear end surface section of said second cam member is sharply increases toward the top of said second cam member.

* * * * *